US007287403B2

(12) United States Patent
Johansson et al.

(10) Patent No.: US 7,287,403 B2
(45) Date of Patent: Oct. 30, 2007

(54) HOOK LATCH

(75) Inventors: Henric Johansson, Husby-Rekarne (SE); Torsten Johansson, Eskilstuna (SE); Claes Magnusson, Värmdö (SE)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 11/108,512

(22) Filed: Apr. 18, 2005

(65) Prior Publication Data

US 2005/0262907 A1 Dec. 1, 2005

Related U.S. Application Data

(60) Provisional application No. 60/562,842, filed on Apr. 16, 2004.

(51) Int. Cl.
*E05B 65/06* (2006.01)

(52) U.S. Cl. ..... 70/137; 292/29; 292/47; 292/109

(58) Field of Classification Search ..... 292/99, 292/100, 121, 122, 139, 97, 27, 46, 47, 123, 292/222, 196, 95, 109, 111, 29, 103, 108, 292/11, 56, 28; 70/137, 123
See application file for complete search history.

(56) References Cited

U.S. PATENT DOCUMENTS 441,674 A * 12/1890 Kubler ..... 70/82
829,180 A * 8/1906 Sweet ..... 70/97
1,284,540 A * 11/1918 Takimoto ..... 70/97
1,793,254 A * 2/1931 Shann ..... 70/355
3,019,043 A * 1/1962 Woodworth et al. ..... 292/113
3,532,373 A * 10/1970 Poe ..... 292/47
3,561,802 A * 2/1971 Brockway ..... 292/49
3,904,229 A * 9/1975 Waldo ..... 292/29
5,221,115 A * 6/1993 Takimoto ..... 292/29
5,520,423 A * 5/1996 Finkelstein et al. ..... 292/146
5,573,287 A * 11/1996 Takimoto ..... 292/29
6,942,259 B2 * 9/2005 Marzolf et al. ..... 292/216

* cited by examiner

*Primary Examiner*—Suzanne Dino Barrett
(74) *Attorney, Agent, or Firm*—Paul & Paul

(57) ABSTRACT

A hook latch for fastening and unfastening a closure member to a keeper in a latched position. The hook latch is moveable between the latched position and an open position. The hook latch comprises a rotation means which preferably comprises a knob connected to a cam shaped protuberance which acts upon an actuator plate and a locking plate. Upon rotation of either the knob or the key which is inserted in a lock cylinder which has a locking ring having a cam-shaped protuberance, the cam-shaped protuberances displace both the actuator plate and the locking plate.

15 Claims, 10 Drawing Sheets

Fig. 25
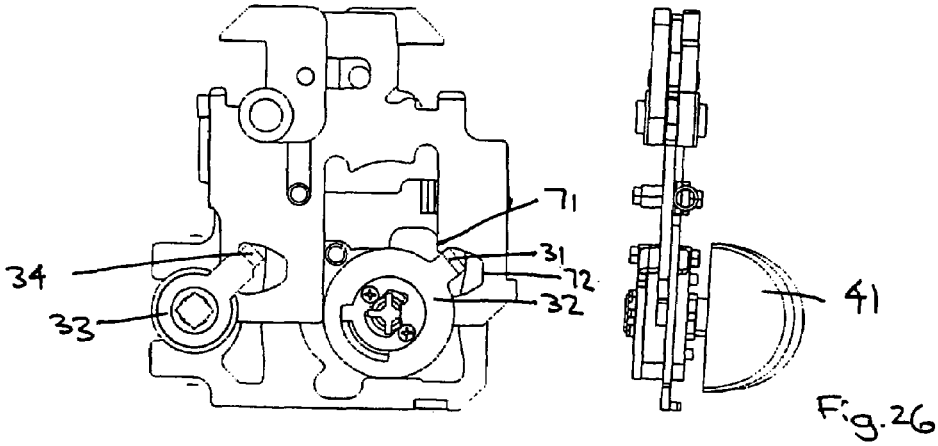
Fig. 26
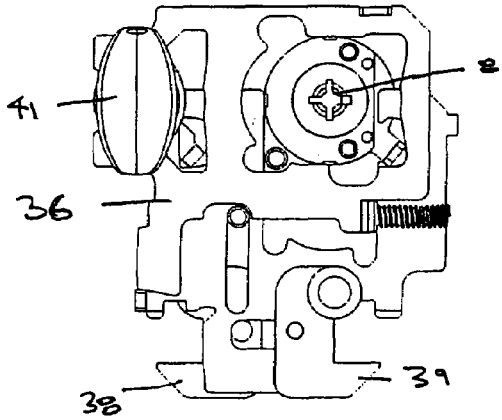
Fig. 27
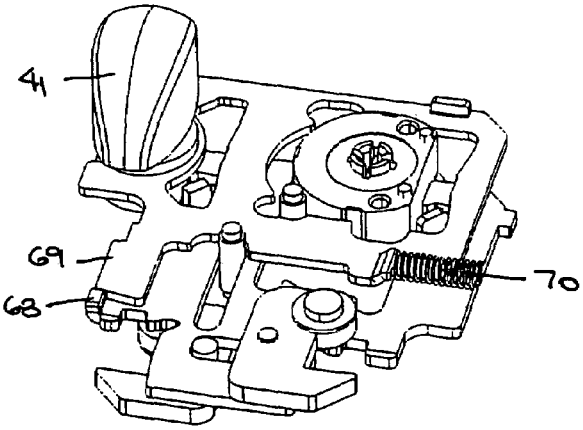
Fig. 28

HOOK LATCH

This application claims the benefit of U.S. Provisional Application No. 60/562,842 filed Apr. 16, 2004 entitled "Hook Latch" the entire specification of which is incorporated by reference.

BACKGROUND OF THE INVENTION

The present invention relates generally to latches.

Latches are known in the art and are provided for the latching and the opening of a member such as a door or panel.

In addition, it is oftentimes desired that the lock cylinder of latches generally have the capability of being opened with a master key in addition to a lower level security key. This is particularly true in the case of marine applications where the individual members of a crew need access to individualized areas which the captain of the vessel also needs access to. However, there may be locked areas which are only to be accessible by the captain of the ship. In such cases, the captain would need a high level security key or master key to access his areas and also the crews areas.

In many prior art lock cylinders, the door or panel in which the lock cylinder was installed needed to be as thick as a significant portion of the length of the key which is inserted into the lock cylinder. This resulted in very long lock cylinders which oftentimes would protrude from the back side of the door or panel due to the length of the lock cylinders. Accordingly, due to space limitations it is desired to have a door or closure member which can accommodate a lock cylinder which is thin or in other words where the length of the axis of the lock cylinder is as short as possible so that the lock cylinder when installed in the door does not protrude from the front or back of the door.

A need therefore exists for a lock cylinder for a latch having a master key capability which can be accommodated in doors of a thickness which prior art lock cylinders could not be accommodated in.

Previously, in order to secure a door or panel with a high degree of security, users were required to operate deadbolt locks which consume valuable space around a door and frame.

A need exists for a low profile, high security, ergonometric latch assembly which can be opened by rotation of a knob on one side of the latch assembly or a lock which is accessible by key turned by a user on the other side of the latch.

The present invention has been developed in view of the foregoing and to overcome the deficiencies of the prior art.

SUMMARY OF THE INVENTION

In accordance with the present invention, it is an object of the invention to provide an ergonometric hook latch which has an easy to use manual lock on one side of the hook latch when the latch is installed either directly in a door or panel, and a second lock on the other side of the hook latch which uses a key. The latch can be actuated by rotation of a knob of the latch or by unlocking of the hook latch through the use of a key.

It is an object to provide an improved lock cylinder having master key capability which is readily adaptable to different thicknesses of doors or closure members.

Another object of the present invention is to provide a door lock that is easy to operate.

A further object of the invention is to provide a lock cylinder which has a very low profile or thickness and which can be used in applications where space and thickness is a limiting factor.

It is a further object of the invention to provide a lock cylinder which can be fitted with two different annular rings, one of which is designed to operate the lock cylinder with only a master key and another which is to operate the lock cylinder with either a master key or a low level security key.

It is another object of the present invention to provide a hook latch for fastening to a keeper which is able to be mounted in any of the following configurations: clamshell, flush-mounted, mortise mounted, and surface mounted.

A further object of this invention is to provide such a lock cylinder with structural components which offers ease of assembly, and reliable operations.

The objects of the present are realized in a hook latch for fastening and unfastening a closure member to a keeper in a latched position. The hook latch is moveable between the latched position and an open position. The hook latch comprises a rotation means which preferably comprises a knob connected to a cam shaped protuberance which acts upon an actuator plate and a locking plate. Upon rotation of either the knob or the key which is inserted in a lock cylinder which has a locking ring having a cam-shaped protuberance, the cam-shaped protuberances displace both the actuator plate and the locking plate. When the locking plate is displaced from the open position, first and second pawls which are each fixed at a rotation point at one end of each of the first pawl and second pawl are also rotatable about the rotation point. Due to the presence of a pawl pin in each of the first pawl and second pawl, the displacing motion of the actuating plate casues a rotation of each of the pawls into the latched position such that the first and second pawl can engage a keeper.

When the rotation of the knob about a first axis or key about a second axis causes the shaped protuberances on the locking ring and the rotation means to extend closest to the opposing axis, the engagement of the protuberances on the locking plate extend the locking plate into an extended position against the urging of a biasing means or coil spring mounted on a biasing means support on the locking plate. As the rotation means is rotated a prong on the actuator plate rides over a detent on the locking plate to a position where the locking plate and actuator plate are in the latched position wherein the locking plate detent prevents motion of the actuator plate back to the open position. The actuator plate is prevented from moving to the open position by interference of the actuator plate prong with the detent on the locking plate until the detent is withdrawn by the withdrawal of the locking plate detent upon rotation of the rotation means or key by a user. Accordingly, accidental motion of the first pawl or second pawl in the latched position or unauthorized tampering with the first or second pawl would not result in the hook latch being opened due to the interference of the actuator plate prong with the detent of the locking plate.

The objects of the present invention are also realized in a lock cylinder configured for a key. Master key functionality is attained by adding an annular ring to the basic lock cylinder structure and modifying the profile of the low level security key. A separate key profile for each key is provided to provide the master key capability. A portion of one of the bits of the master key is machined deeper than the low level security key and has a key stop where the bit abuts the stem. When the lock cylinder is provided with a master annular ring, the lock cylinder can only be operated by the master key and not the limited access low level security key due to the presence of a tab on the master annular ring provided on the front of the lock cylinder which prevents entry of the limited access or low level security key into the lock cylinder. The master key can also operate the lock cylinder when the lock cylinder is fitted with a low level security annular ring which does not have the tab which is present on the master annular ring.

BRIEF DESCRIPTION OF THE DRAWINGS

The features, advantages and operation of the present invention will become readily apparent and further understood from a reading of the following detailed description of the invention with the accompanying drawings, in which like numerals refer to like elements, in which:

FIG. 25 is a bottom plan view of the hook latch of the present invention in the latched position with the hook latch cover plate and hook latch frame removed;

FIG. 26 is a side view of the hook latch of the present invention in the latched position with the hook latch cover plate and hook latch frame removed;

FIG. 27 is a top plan view of the hook latch of the present invention in the latched position with the hook latch cover plate and hook latch frame removed;

FIG. 28 is a perspective view of the hook latch of the present invention in the latched position with the hook latch cover plate and hook latch frame removed;

DETAILED DESCRIPTION OF THE INVENTION

Figure 20:
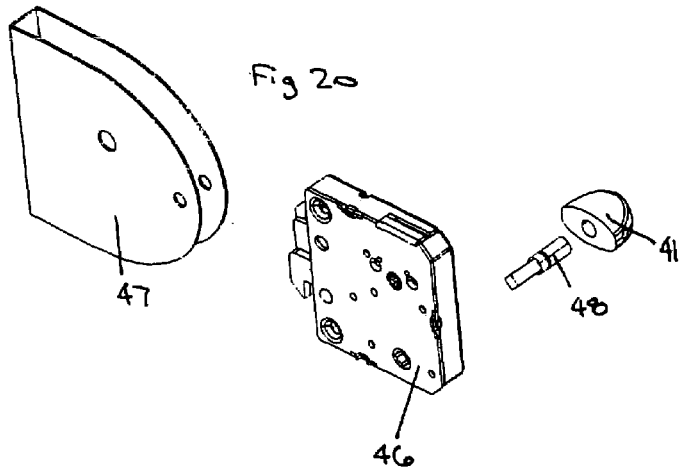
FIG. 20 is an exploded view of the hook latch of the present invention in a clamshell configuration.
Figure 21:
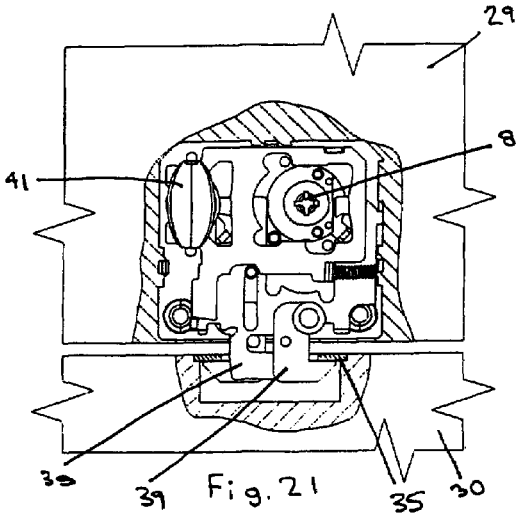
FIG. 21 is a top plan view partially cut away of the hook latch of the present invention latched to a keeper 35.

FIGS. 16-19 show the hook latch of the present invention in a clamshell configuration in a door 29. Rotation of the key 1 or knob 41 actuates the latch and first and second pawl move from the latched and unlatched position. FIG. 20 shows the knob stem 48 which actuates rotation means 33 which in turn actuates rotation means protuberance 34 seen in FIG. 22 where the hook latch latches door 29 to frame 30.

Figure 22:
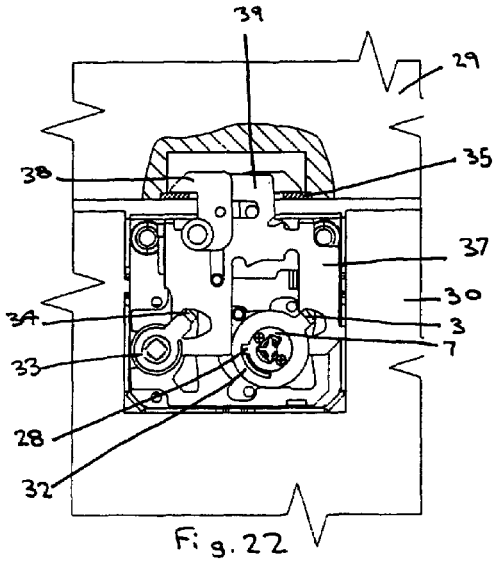
FIG. 22 is a bottom plan view partially cutaway of the hook latch of the present invention latched to a keeper.

In FIG. 22, rotation of the low level security annular ring 7 by a key (not shown) rotates actuator 28 such that locking ring protuberance 31 of locking ring 32 has displaced actuator plate 37, by engagement of the locking ring protuberance 31 with second actuator plate aperture 51, into the extended position in which first pawl 38 and second pawl 39 are latched.

Figure 23:
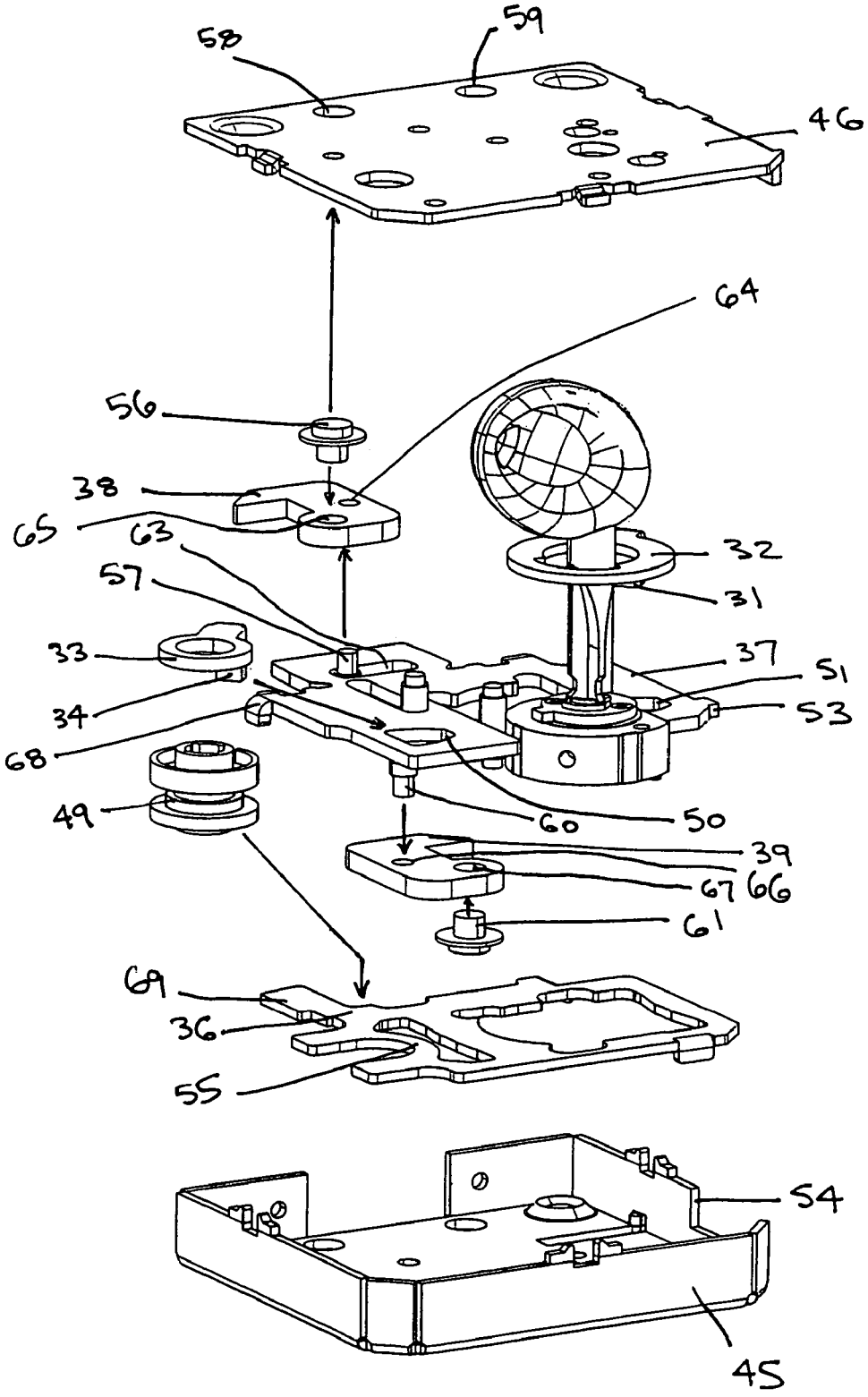
FIG. 23 is an exploded view of the hook latch of the present invention in the latched position.
Figure 24:
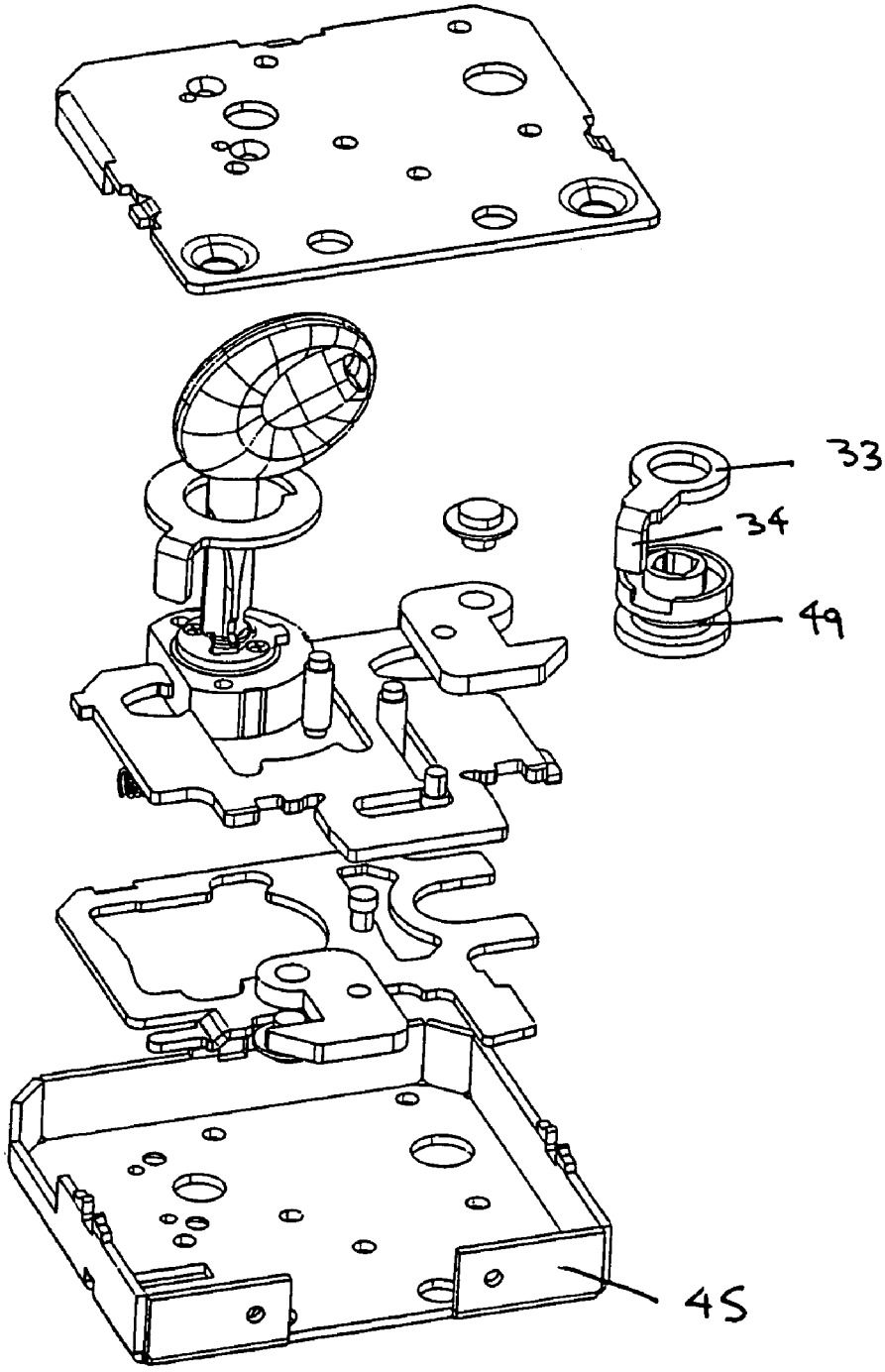
FIG. 24 is an exploded view of the hook latch of the present invention in the open position with the hook latch cover plate and hook latch frame removed.
Figure 30:
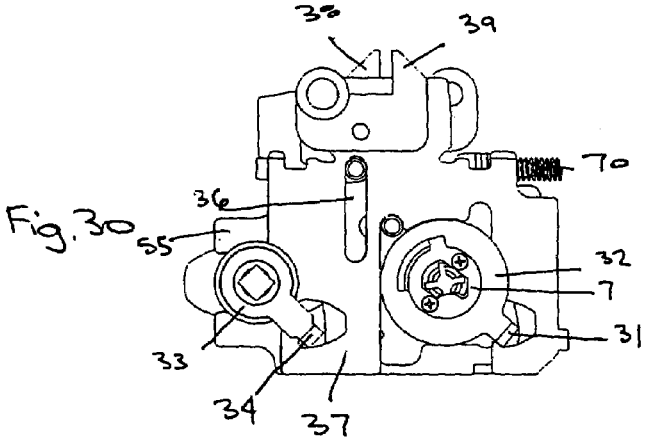
FIG. 30 is a bottom plan view of the hook latch of the present invention in the open position with the hook latch cover plate and hook latch frame removed.
Figure 31:
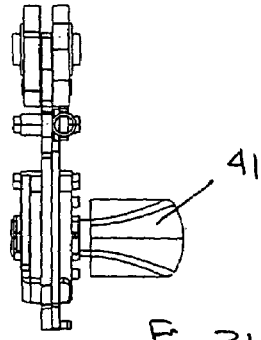
FIG. 31 is a side view of the hook latch of the present invention in the open position with the hook latch cover plate and hook latch frame removed.
Figure 32:
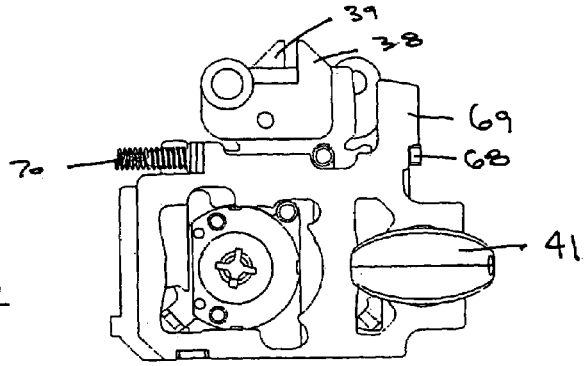
FIG. 32 is a top plan view of the hook latch of the present invention in the open position with the hook latch cover plate and hook latch frame removed.

In the exploded views of FIGS. 23 and 24 of the hook latch, it can be seen that the rotation of a knob which in turn rotates rotator 49 in yoke 55 causes rotation means protuberance 34 in first actuator plate aperture 50 to displace actuator plate 37 such that the first pawl 38 and second pawl 39 rotate to the latched position. This is achieved by the rotation of first pawl 38 about first pawl rotation pin 56 which causes first pawl actuation pin 57 which is connected to first pawl 38 at first pawl actuator pin aperture 64 to move in actuator plate slot 63. First pawl 38 rotates about first pawl rotation pin aperture 58 in cover plate 46 and first pawl aperture 65.

The second pawl 39 rotates in a similar way as first pawl 38. Rotation of second pawl 39 about second pawl rotation pin 61 causes second pawl actuation pin 60 which is connected to second pawl 39 at second pawl actuator pin aperture 66 to move in actuator plate slot 63. Second pawl 39 rotates about second pawl rotation pin aperture 59 in cover plate 46 and second pawl aperture 67.

As the rotation means 33 is rotated actuator plate prong 68 on the actuator plate 37 rides over a locking plate detent 69 on the locking plate 36 to a position where the locking plate 36 and actuator plate 37 are in the latched position wherein the locking plate detent 69 prevents motion of the actuator plate 37 back to the open position as seen. The actuator plate 37 is prevented from moving to the open position by interference of the actuator plate prong 68 with the locking plate detent 69 on the locking plate 39 until the locking plate detent 69 is withdrawn by the withdrawal of the locking plate detent 69 upon of the key or knob by a user to move the latch to the open position. Accordingly, accidental motion of the first pawl 38 or second pawl 39 in the latched position or unauthorized tampering with the first pawl 38 or second pawl 39 would not result in the hook latch being opened due to the interference of the actuator plate prong 68 with the locking plate detent.

The latching means also comprises a biasing means 70 here a coil spring which biases the latch to the open or latched position.

Figure 29:
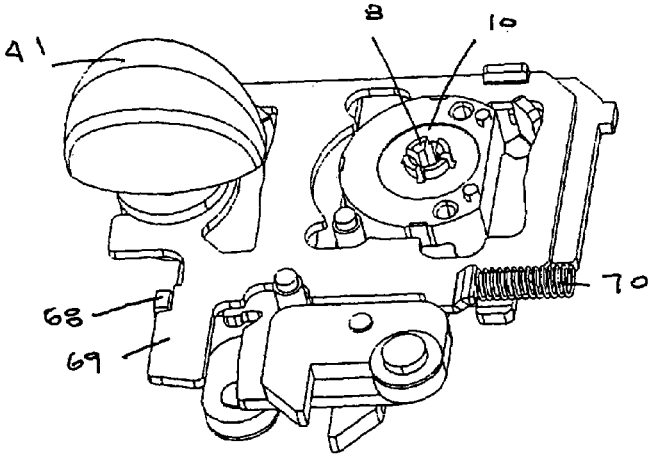
FIG. 29 is a perspective view of the hook latch of the present invention in the open position with the hook latch cover plate and hook latch frame removed.

The latch can be maintained in the open position by action of the locking plate detent 69 upon the actuator plate prong 68 as seen in FIG. 29.

As seen in FIG. 25, when the knob 41 is rotated actuator plate corner 71 and actuator plate guide 72 ensure that the locking ring protuberance moves in concert with rotation means protuberance 34.

As seen in FIG. 23, motion of the actuator plate 37 is stopped by engagement of actuator plate stop 53 with actuator plate frame stop 54.

Figure 1:
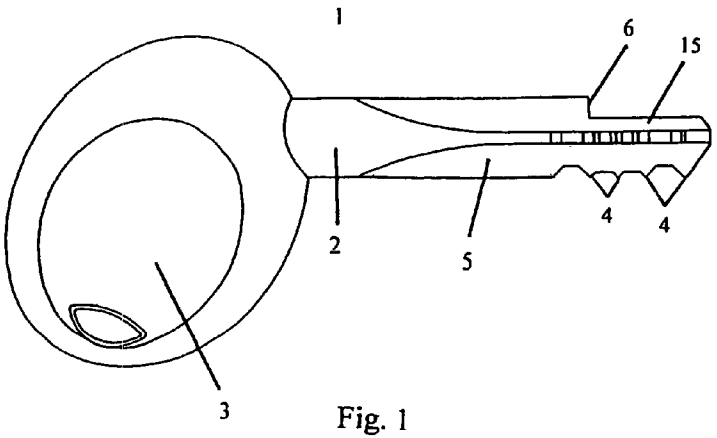
FIG. 1 is a side elevational view of the low level security key for use with one embodiment of the present invention.
Figure 3:
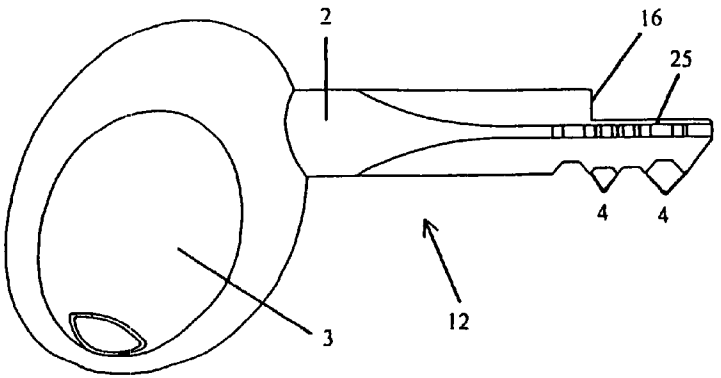
FIG. 3 is a side elevational view of the master key for use with one embodiment of the present invention.

The hook latch can be locked and unlocked in two different ways: by either the use of a key, most preferably by low level security key 1 or master key 12 as shown in FIGS. 1 and 3.

The lock plug 8 can be provided for access by the low level security key 1 or the master key 12 as described in detail below.

The above described invention permits a user to rotate front handle 66 or rear handle 67 and actuate the actuator in the direction of the pawl actuator 31 and allows the user to latch a door or panel in which the latch assembly is installed to a keeper.

In a preferred embodiment of the present invention, the hook latch is adapted for use with a low level security key and/or a master key.

Figure 5:
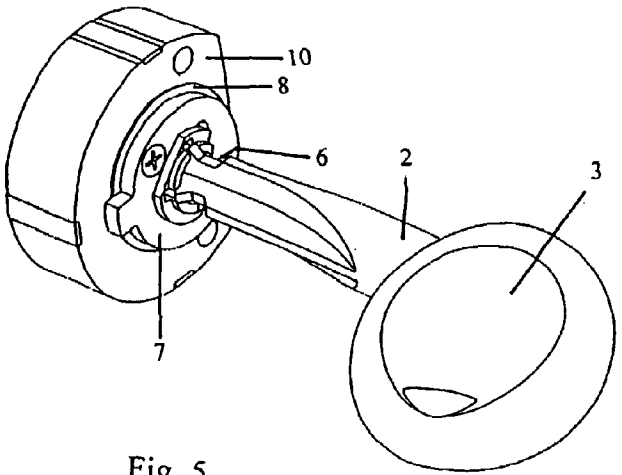
FIG. 5 is a perspective view of the lock cylinder and low level security key for use with one embodiment of the present invention in a locked state shown with a low level security annular ring.
Figure 7:
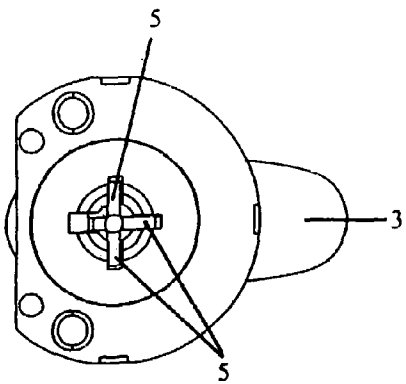
FIG. 7 is a rear elevational view of the lock cylinder and low level security key for use with one embodiment of the present invention in a locked state shown with a low level security annular ring.
Figure 9:
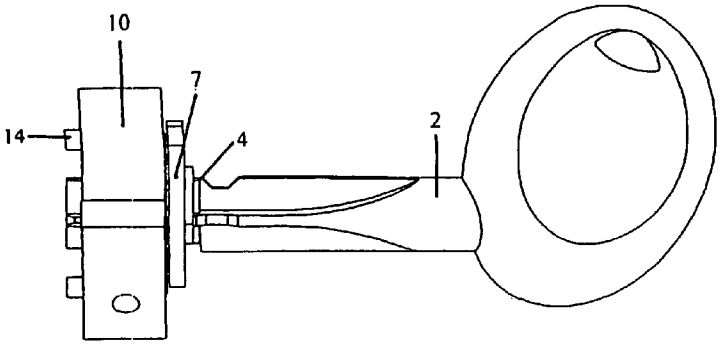
FIG. 9 is a side elevational view of the lock cylinder and low level security key for use with one embodiment of the present invention in an unlocked state shown with a low level security annular ring.

As seen in FIG. 1, low level security key 1 has grip portion 3 to be held by a user of the low level security key 1 and a stem 2 extending from the grip portion 3. Individual bittings 4 are formed on at least one of the bits of the low level security key 1. Stem 2 of the key 1 which is preferably cylindrical in cross section extends from the grip portion 3 to the bits of the low level security key 1. As shown in this embodiment the low level security key 1, one end of the low level security key 1 is in a star profile as seen in FIG. 7 and has three bitted bits 5. The fourth bit which forms part of the remaining portion of the star profile is the low level security key stop bit 15 which terminates in a low level security key stop 6. Low level security key 1 is dimensioned and configured to be inserted into lock cylinder 13 which has low level security annular ring 7 as seen in FIG. 5 until low level security key stop 6 contacts low level security annular ring 7 which thereby prevents further insertion of low level security key 1 into lock plug 8.

The low level security key stop 6 has a depth equal to the difference between the distance from the top of the low level security key stop bit 15 to the axis of low level security key 1 and the distance from the top of the low level security key stop 6 to the axis of the low level security key, wherein the depth of the low level security key stop 6 is less than the depth of the master key stop 16.

Figure 6:
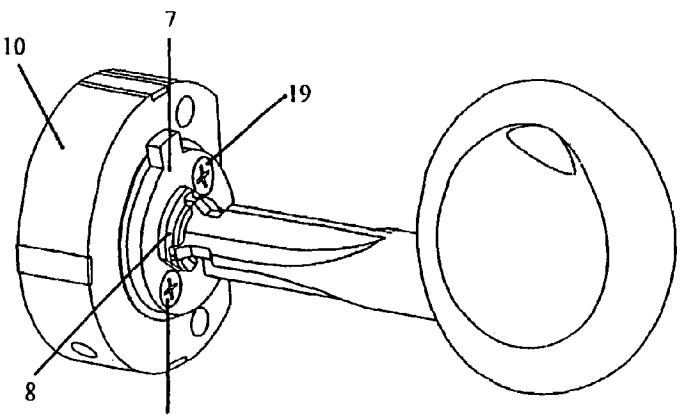
FIG. 6 is a perspective view of the lock cylinder and low level security key for use with one embodiment of the present invention in an unlocked state shown with a low level security annular ring.
Figure 8:
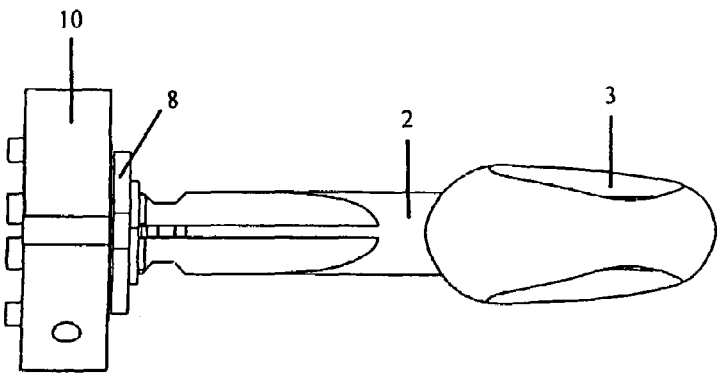
FIG. 8 is a side elevational view of the lock cylinder and low level security key for use with one embodiment of the present invention in a locked state shown with a low level security annular ring.

When the lower level security key 1 or master key 12 is inserted, one or more of the bitted bits 5 engage tumblers (not shown) in the lock plug 8 and lock shell 10 which in the locked state extend from lock plug apertures 24 in the lock plug 8 into corresponding lock shell apertures 24 in lock shell 10. After insertion of the low level security key 1, the bitted bits 5 push and align the tumblers which are preferably biased by a biasing means such as a coil spring into positions such that none of the tumblers contacts simultaneously both the lock plug 8 and the lock shell 10 thereby permitting rotation of the lock shell 10 relative to lock plug 8. A user then turns grip portion 3 of the low level security key 1 in a clockwise direction as seen in FIG. 6 to unlock the lock plug 8 from the lock shell 10.

Figure 2:
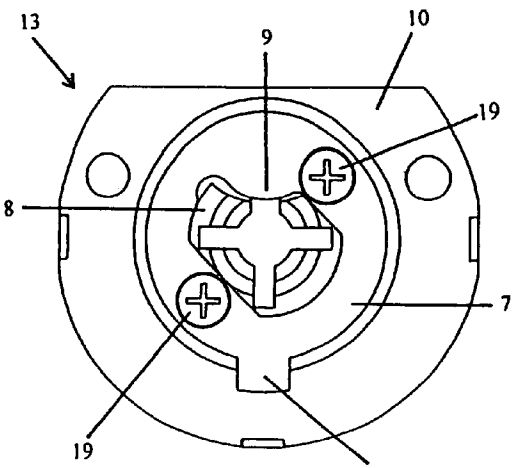
FIG. 2 is a front elevational view of the lock cylinder for use with one embodiment of the present invention having a low level security annular ring.

Lock cylinder 13 of FIG. 2 which is shown with low level security annular ring 7 also accommodates master key 12 of FIG. 3 as the depth of master key stop 16 is sufficiently deep as measured from the top of the master key stop 16 to the top of the master key stop bit 25 to permit passage of the master key 12 into the lock plug 8 until master key stop 16 is prevented from being inserted further into the lock plug 8 by contact with ring stop 9 on low level annular ring 7. The master key stop 16 has a depth equal to the difference between the distance from the top of the master key stop bit 25 to the axis of the master key 12 and the distance from the top of the master key stop 16 to the axis of the master key 12. Therefore, lock cylinder 13 when provided with the low level annular ring 7 can be operated with either the master key 12 or low level security key 1.

Figure 4:
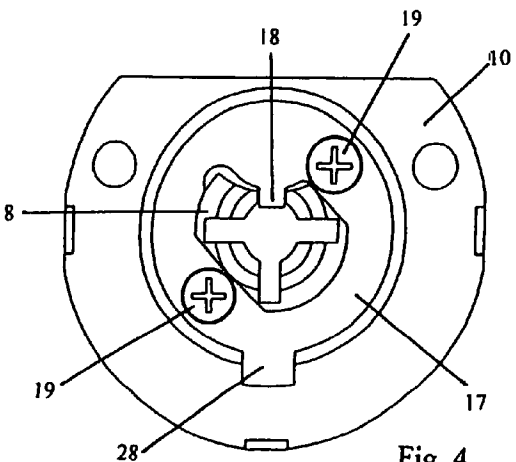
FIG. 4 is a front elevational view of the lock cylinder for use with one embodiment of the present invention having a master annular ring.

In FIG. 4, the same lock plug 8 and lock shell 10 as seen in FIG. 2 is provided, however a master annular ring 17 is shown screwed to the front of the lock plug 8 by screws 19. The master annular ring 17 is different from the low level annular ring 7 of FIG. 2 in that the master annular ring 17 has a tab 18 which prevents insertion of low level security key 1 into lock plug 8. The low level security key 1 is prevented from being inserted into the lock plug 8 by the contact of low level key stop 6 against tab 18. On the other hand, master key 12 can be inserted into lock plug 8 in FIG. 4 because of the greater depth of master key stop 16 which permits passage of the master key stop bit 25 below tab 18. Accordingly, master key 12 can function as a master key which has the capability of opening both the lock cylinder 13 when it is provided with a low level security annular ring 7 and the lock cylinder 13 when it is provided with a master annular ring 17.

In the same way if a user were to try to insert the low level security key 1 in the lock cylinder 13 while the lock cylinder 13 is fitted with a master annular ring, the bit 15 would be blocked from entering the lock cylinder 13 by tab 18 on the master annular ring 17.

Figure 11:
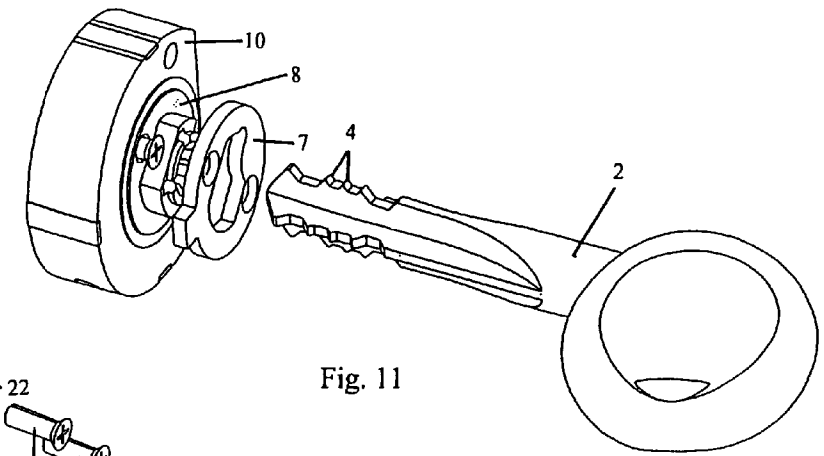
FIG. 11 is an exploded view of the lock cylinder and low level security key for use with one embodiment of the present invention in a locked state shown with a low level security annular ring.
Figure 10:
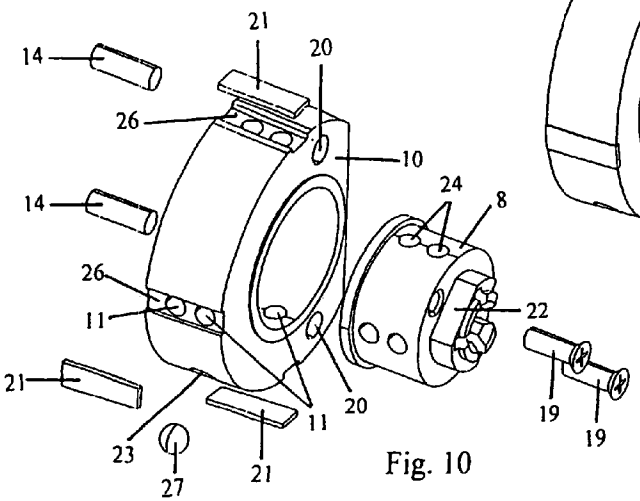
FIG. 10 is an exploded view of the lock cylinder for use with one embodiment of the present invention without either a master annular ring or a low level security annular ring.

FIGS. 10 and 11 show an exploded view of the lock cylinder 13 of the present invention having shell 10 and lock plug 8. In order to provide for mounting of the lock cylinder 13 in a latch, prongs 14 are provided mounted in an apertures 20 in the lock shell 10. Also, the lock shell 10 is provided with grooves in which plates 21 are fitted to keep biasing means, i.e. coil springs, and tumblers in the lock shell 10 and lock plug 8. Lock plug 8 is also fitted with ring support 22 which serves to maintain the relative position of either the master annular ring 17 or the low level security annular ring 7. In a preferred embodiment, the lock shell 10 is fitted with a ball bearing aperture 23 in which ball bearing 27 is located together with a biasing means (not shown) such as a coil spring. The ball bearing 27 in the ball bearing aperture 23 is biased toward the lock plug 8 which has a detent (not shown) in which a portion of the ball bearing 27 will rest when the lock plug 8 is properly aligned with lock shell 10.

Preferably, the lock plug 8 is located concentric to and rotatable inside of and relative to said lock shell 10, and said lock plug 8 is configured for insertion of said master key 12 or said low level security key 1.

Figure 12:
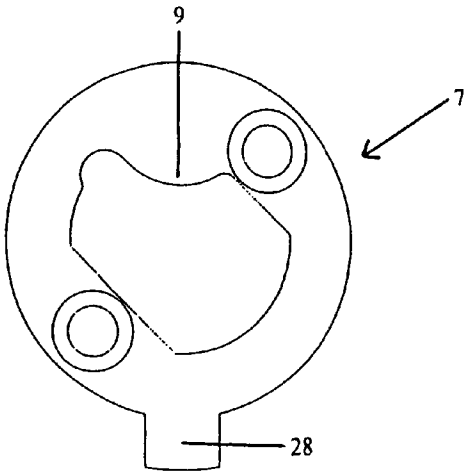
FIG. 12 is a top plan view of the low level security annular ring for use with one embodiment of the lock cylinder of the present invention.
Figure 13:
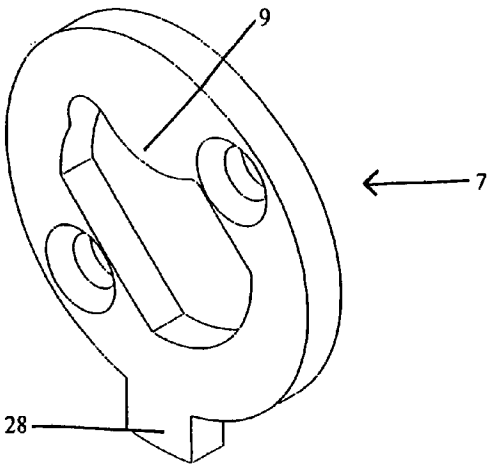
FIG. 13 is a perspective view of the low level security annular ring for use with one embodiment of the lock cylinder of the present invention.
Figure 14:
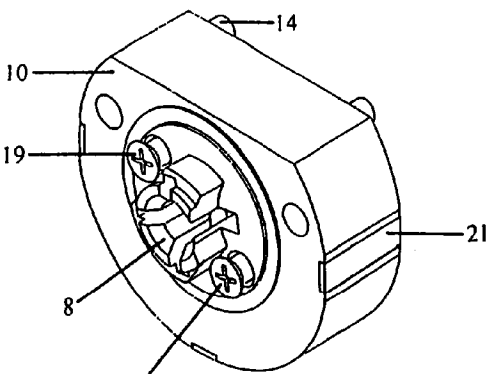
FIG. 14 is a perspective view of the lock cylinder for use with one embodiment of the present invention shown without a low level security annular ring or a master annular ring.
Figure 15:
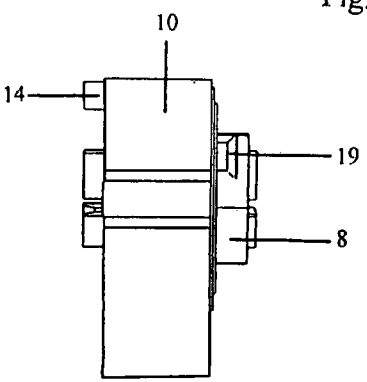
FIG. 15 is a side view of the lock cylinder for use with one embodiment of the present invention shown without a low level security annular ring or a master annular ring.
Figure 16:
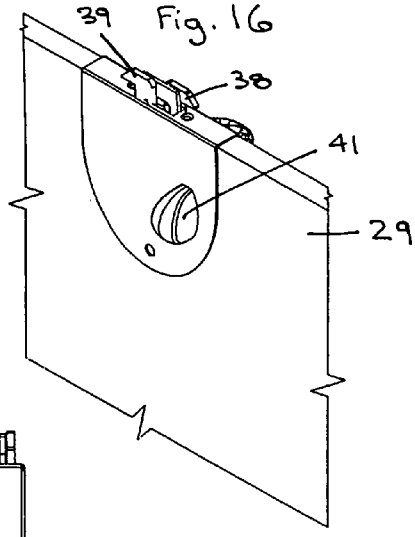
FIG. 16 is a perspective view of hook latch of the present invention in the latched position installed in a door in a clamshell configuration, the hook latch having a knob a key inserted.
Figure 17:
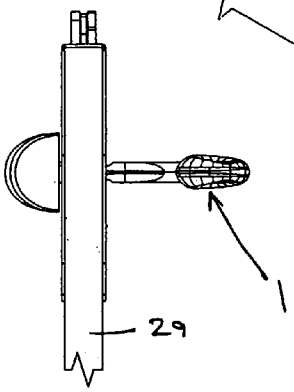
FIG. 17 is a side view of the hook latch of FIG. 17 in the latched position.
Figure 18:
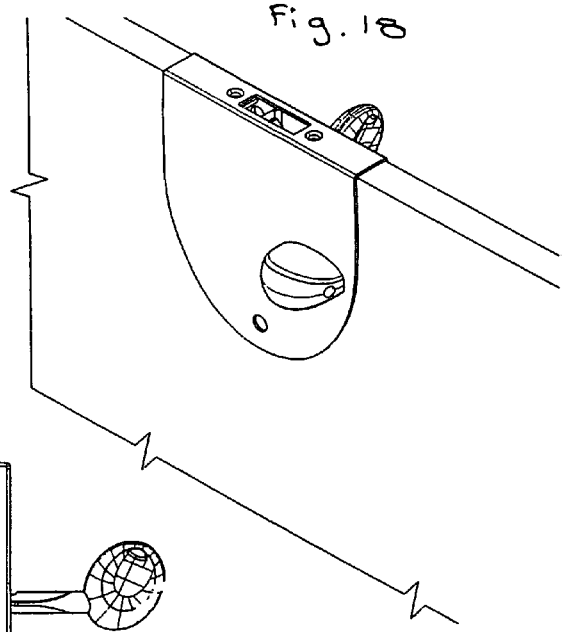
FIG. 18 is a perspective view of hook latch of the present invention in the open position installed in a door in a clamshell configuration, the hook latch having a knob a key inserted.
Figure 19:
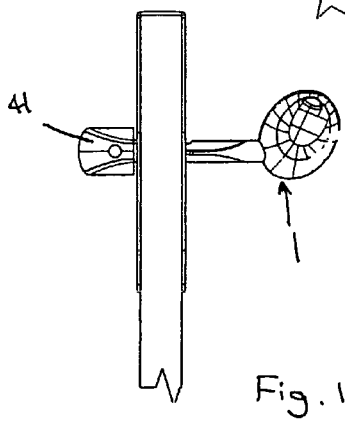
FIG. 19 is a side view of the hook latch of FIG. 18 in the open position.

Low level security annular ring 7 as shown in FIGS. 12 and 13 has a ring stop 9 which contacts key stop 6 when the low level security key 1 is used and which contacts master key stop 16 when the master key 12 is used. The ring stop 9 can be of any shape which permits insertion of the master key 12 and the low level security key 1 into the lock plug 8 but acts as a stop against a portion of the master key stop 16 or low level security key stop 6 respectively. The tab 18 of the master annular ring 17 can be of any shape, thickness or configuration which permits insertion of the master key 12 up to the master key stop 16 but which does not permit insertion of the low level security key 1 due to contact of the low level security key stop bit 15 against the tab 18.

Tab 18 extends into an interior portion of the ring formed by the master annular ring 17 and the tab 18 permits insertion of the master key stop bit 25 into the lock plug 8 until the master key stop 16 contacts the tab 18 on the master annular ring 17.

Actuator 28 on master annular ring 17 or low level annular ring 7 which are both preferably in the form of a ring actuate the means by which the latch or lock in which the lock cylinder 13 is unlocked when a user unlocks the lock cylinder 13 and rotates either the master key 12 or low level security key 1.

As can be seen by a comparison of FIG. 1 and FIG. 3, a master key and a low level security key can preferably be provided which can have identical bittings on the bits of the two keys. However, when the basic lock cylinder configuration of a lock plug and lock shell is provided with a master annular ring then only the master key can open the lock cylinder. However, the lock cylinder can be opened by a low level security key or master key when the lock cylinder is fitted with the low level security annular ring.

Many changes can be made in the above-described invention without departing from the intent and scope thereof. It is therefore intended that the above description be read in the illustrative sense and not in the limiting sense. Substitutions and changes can be made without departing from the scope and intent of the invention.

We claim:

1. A latch for fastening to a keeper in a latched position, the latch being moveable between a latched position for engaging a keeper and an open position, the latch comprising:

a first pawl for engaging the keeper when the latch is in the latched position, the first pawl being rotatable between a latched position for engaging the keeper and an open position;

a second pawl for engagement with the keeper when the latch is in the latched position, the second pawl being rotatable between a latched position for engaging the keeper and an open position;

an actuator plate for rotating the first pawl and second pawl from the open position to the latched position, the actuator plate being slidingly displaceable in a direction in the latch between a first position in which the first pawl and the second pawl are in the latched position and a second position in which the first pawl and the second pawl are in the open position and having an actuator plate prong;

an actuating means for slidingly displacing the actuator plate;

a rotation means for rotating the actuating means such that the actuating means slidingly displaces the actuator plate; the rotation means having a knob for rotating the rotation means;

a locking plate having a locking plate detent for engagement with the actuator plate prong and a biasing means, the locking plate being displaceable by the actuating means in the latch in a direction substantially perpendicular to the direction in which the actuator plate is slidingly displaceable by the actuating means, the locking plate being biased by the biasing means such that the latch is selectively maintained by the biasing means in the latched position in which the actuator plate prong engages a first portion of the locking plate detent or in the open position in which the actuator plate prong engages a second portion of the locking plate detent; and a lock cylinder, said lock cylinder having a locking ring rotatable using the lock cylinder, the locking ring having a locking ring protuberance for slidingly displacing the actuator plate and displacing the locking plate in a direction substantially perpendicular to the direction in which the actuator plate is slidingly displaceable by the locking ring protuberance.

2. The latch of claim 1 wherein the actuator plate has opposed faces and the first pawl and the second pawl are located adjacent to each of the opposed faces of the actuator plate.

3. The latch of claim 1 further comprising a first pawl rotation pin and a second pawl rotation pin and wherein the actuator plate has an actuator plate slot, and the latch further comprises a first pawl actuation pin connected to the first pawl and a second pawl actuation pin connected to the second pawl, the first pawl being rotatable about the first pawl rotation pin and the second pawl being rotatable about the second pawl rotation pin by sliding movement of the first pawl actuation pin and the second pawl actuation pin in the actuator plate slot during sliding of the actuator plate.

4. The latch of claim 1, wherein the actuator plate has a substantially linear slot for guiding the sliding movement of the actuator plate, the latch further comprising a latch pin extending through the linear slot for guiding the sliding movement of the actuator plate.

5. The latch of claim 1 wherein the latch has opposed first and second major faces and has a knob located adjacent to the first major face and a key for rotating the lock cylinder is insertable in the lock cylinder through the second major face.

6. The latch of claim 1 wherein the locking plate has a prong for mounting the biasing means.

7. The latch of claim 6 wherein the biasing means is a coil spring.

8. The latch of claim 1 wherein the actuating means engages the actuator plate at a first aperture in the actuator plate.

9. The latch of claim 8 wherein a locking ring actuator engages the actuator plate at a second aperture in the actuator plate.

10. A latch for fastening to a keeper in a latched position, the latch being moveable between a latched position for engaging a keeper and an open position, the latch comprising:

a first pawl for engaging the keeper when the latch is in the latched position, the first pawl being rotatable between a latched position for engaging the keeper and an open position;

a second pawl for engagement with the keeper when the latch is in the latched position, the second pawl being rotatable between a latched position for engaging the keeper and an open position;

a first pawl actuation pin connected to the first pawl;

a second pawl actuation pin connected to the second pawl;

a first pawl rotation pin;

a second pawl rotation pin;

an actuator plate for rotating the first pawl and second pawl from the open position to the latched position, the actuator plate being slidingly displaceable in a direction in the latch between a first position in which the first pawl and the second pawl are in the latched position and a second position in which the first pawl and the second pawl are in the open position and having an actuator plate prong, the actuator plate having an actuator plate slot, wherein the first pawl is rotatable about the first pawl rotation pin and the second pawl is rotatable about the second pawl rotation pin by sliding movement of the first pawl actuation pin and the second pawl actuation pin in the actuator plate slot during sliding of the actuator plate in the latch;

an actuating means for slidingly displacing the actuator plate; and a locking plate having a locking plate detent for engagement with the actuator plate prong and a biasing means, the locking plate being displaceable by the actuating means in the latch in a direction substantially perpendicular to the direction in which the actuator plate is slidingly displaceable by the actuating means, the locking plate being biased against the biasing means such that the latch is selectively maintained by the biasing means in the latched position in which the actuator plate prong engages a first portion of the locking plate detent or in the open position in which the actuator plate prong engages a second portion of the locking plate detent.

11. The latch of claim 10 further comprising a rotation means for rotating the actuating means such that the actuating means slidingly displaces the actuator plate.

12. The latch of claim 11 wherein the rotation means has a knob for rotating the rotation means.

13. The latch of claim 10 wherein the actuator plate has opposed faces and the first pawl and the second pawl are located adjacent to each of the opposed faces of the actuator plate.

14. The latch of claim 12 further comprising a lock cylinder, said lock cylinder having a locking ring rotatable using the lock cylinder, the locking ring having a locking ring protuberance for slidingly displacing the actuator plate and displacing the locking plate in a direction substantially perpendicular to the direction in which the actuator plate is slidingly displaceable by the locking ring protuberance.

15. The latch of claim 10, wherein the actuator plate has a substantially linear slot for guiding the sliding movement of the actuator plate, the latch further comprising a latch pin extending through the linear slot for guiding the sliding movement of the actuator plate.

* * * * *